US009502792B2

(12) United States Patent
Kim et al.

(10) Patent No.: US 9,502,792 B2
(45) Date of Patent: Nov. 22, 2016

(54) EARTH APPARATUS OF VEHICLE

(71) Applicant: Hyundai Motor Company, Seoul (KR)

(72) Inventors: Dae Su Kim, Whasung-Si (KR); Ho Sung Tak, Whasung-Si (KR)

(73) Assignee: Hyundai Motor Company, Seoul (KR)

( * ) Notice: Subject to any disclaimer, the term of this patent is extended or adjusted under 35 U.S.C. 154(b) by 208 days.

(21) Appl. No.: 14/243,308

(22) Filed: Apr. 2, 2014

(65) Prior Publication Data

US 2015/0155642 A1 Jun. 4, 2015

(30) Foreign Application Priority Data

Nov. 29, 2013 (KR) ..... 10-2013-0147281

(51) Int. Cl.

| | |
|---|---|
| ***H01R 4/02*** | (2006.01) |
| ***H01R 4/26*** | (2006.01) |
| ***H01R 4/58*** | (2006.01) |
| ***H01R 4/64*** | (2006.01) |
| ***H01R 4/34*** | (2006.01) |
| *H01R 13/648* | (2006.01) |

(52) U.S. Cl.
CPC *H01R 4/64* (2013.01); *H01R 4/34* (2013.01); *H01R 4/029* (2013.01); *H01R 13/648* (2013.01); *H01R 2201/26* (2013.01)

(58) Field of Classification Search
CPC ..... H01R 4/34; H01R 4/64
USPC ..... 174/5 SG, 2, 5 R, 6, 7, 45 R, 51, 40 R
See application file for complete search history.

(56) References Cited

U.S. PATENT DOCUMENTS 6,125,524 A * 10/2000 Mueller ..... B23P 19/062 29/515
8,287,219 B2 * 10/2012 Opper ..... H01R 11/12 411/301

FOREIGN PATENT DOCUMENTS

| | | | |
|---|---|---|---|
| JP | 06-010931 | A | 1/1994 |
| JP | 06-042519 | A | 2/1994 |
| JP | 2003-106322 | A | 4/2003 |
| JP | 2003-120640 | A | 4/2003 |
| KR | 1020020052536 | A | 7/2002 |
| KR | 1020050042334 | A | 5/2005 |

* cited by examiner

*Primary Examiner* — Jenny L Wagner
*Assistant Examiner* — Michael E Moats, Jr.
(74) *Attorney, Agent, or Firm* — Morgan, Lewis & Bockius LLP

(57) ABSTRACT

The present invention provides an earth apparatus of a vehicle, which includes a panel having a through-hole, a fastener having a panel-shaped support portion with an open side at one side and a nut portion fitted in the through-hole of the panel, and an earth member combined by the fastener, connected with an earth wire at one side, and having a guide bending downward at a predetermined length at the other side such that the guide is combined at a position corresponding to the open side of the support portion of the fastener.

8 Claims, 3 Drawing Sheets

EARTH APPARATUS OF VEHICLE

CROSS-REFERENCE TO RELATED APPLICATION

The present application claims priority of Korean Patent Application Number 10-2013-0147281 filed on Nov. 29, 2013, the entire contents of which application are incorporated herein for all purposes by this reference.

BACKGROUND OF INVENTION

Field of Invention

The present invention relates to an earth apparatus for earthing a vehicle, and more particularly to an earth apparatus of a vehicle which can improve the NVH (Noise, Vibration, Harshness) performance of a vehicle.

Description of Related Art

In general, the earth apparatuses of vehicles are configured to prevent an injury due to leaking current by fixing an earth wire connected to a battery to car body panels with a bolt or a nut in order to prevent a current of a battery used in the vehicles from flowing to the user's body in driving or repairing the vehicles.

Korean Patent Publication No. 2002-0052536 A discloses a method of mounting an earth wire on an earth frame inside a car body frame, which includes: a first step of welding a head portion of an earth bolt to a side of an earth frame before electrodepositing in painting and of fitting a bolt cap to the threaded portion of the earth bolt to prevent electrodeposition of paint in the electrodepositing; a second step of removing the bolt cap fitted on the earth bolt in decorating after all of painting including electrodepositing of a vehicle is finished, next to the first step; a third step of fitting an earth ring terminal connected with the earth wire to the threaded portion of the earth bolt with the bolt cap removed in the second step; and a fourth step of completely fixing the earth ring terminal to the earth bolt by fitting a nut on the threaded portion of the earth bolt, next to the third step, in order to prevent an injury due to leaking current.

However, the earth member is combined through a through-hole of a car body panel and the wire ring connected to the earth member should be assembled in a specific direction. Accordingly, a guide hole is separately formed around a through-hole where an earth member is combined and a guide protrusion is formed on the earth member to be fitted in the guide hole, thereby providing directionality in the related art, but noise and vibration are generated in traveling of a vehicle due to the guide hole formed in the panel, so the NVH performance is deteriorated and the exhaust gas flows into the interior.

Therefore, there is a need of an earth apparatus of a vehicle which can keep airtightness to prevent an exhaust gas from flowing into the interior while easily ensuring directionality of an earth member with a simple structure and improving the NVH performance.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to provide an earth apparatus of a vehicle which can keep airtightness to prevent an exhaust gas from flowing into the interior while easily ensuring directionality of an earth member with a simple structure and improving the NVH performance.

An earth apparatus of a vehicle according to various aspects of the present invention includes: a panel having a through-hole, a fastener having a panel-shaped support portion with an open side at one side and a nut portion fitted in the through-hole of the panel, and an earth member combined by the fastener, connected with an earth wire at one side, and having a guide bending downward at a predetermined length at the other side such that the guide is combined at a position corresponding to the open side of the support portion of the fastener.

A protrusion that protrudes upward may be formed on the panel, at a predetermined distance from the through-hole. The protrusion of the panel may provide guidance for combining the open side of the support portion of the fastener to the panel at a position corresponding to the protrusion. The support portion of the fastener may be formed in the shape of a disc having a predetermined thickness. The fastener may be a weld nut.

A coupling member may be fitted in the fastener from above. The earth member may be disposed between the coupling member and the fastener. The coupling member may be a bolt and a thread is formed on the inner side of the nut portion of the fastener.

According to the earth apparatus of a vehicle having the structure described above, a simple structure is achieved and a fastening force is increased, and thus the earth performance is improved. It is possible to provide directionality of the earth member, removing a guide hole of a car body panel, so assembling is easy and efficiency of the assembling process is improved.

Further, since a weld nut with a circular support portion is used, the fastening performance to the panel is improved and airtightness on the panel of a car body is ensured. Accordingly, foreign substances are prevented from flowing into the interior of a vehicle, which increases durability of the vehicle. Further, the NVH performance is improved and an exhaust gas is prevented from flowing into the interior.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

The above and other features of the present invention will now be described in detail with reference to certain exemplary embodiments thereof illustrated by the accompanying drawings which are given hereinbelow by way of illustration only, and thus are not limitative of the present invention, and wherein.

Figure 1:
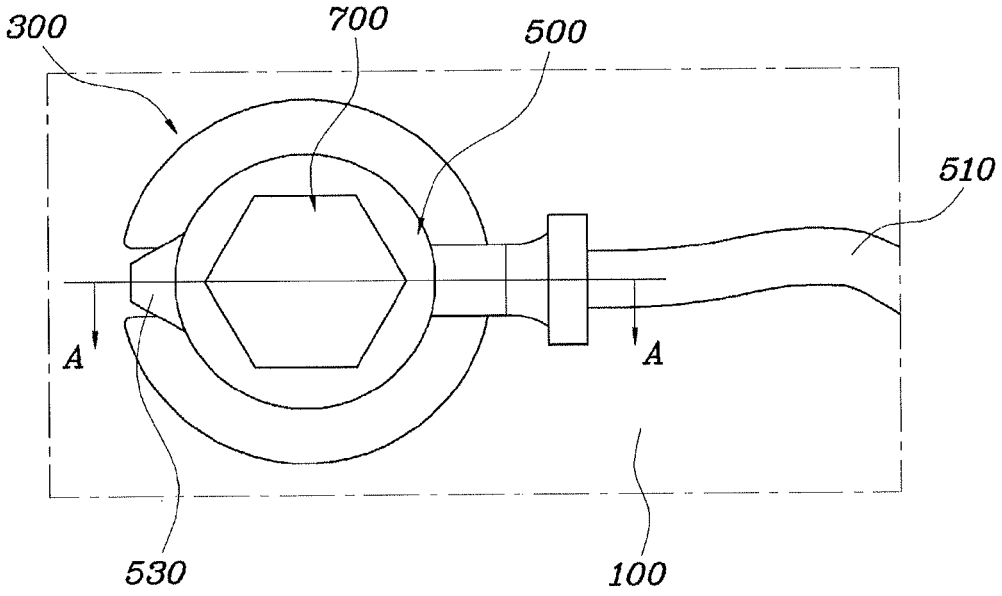
FIG. 1 is a view showing an exemplary earth apparatus of a vehicle according to the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 2:
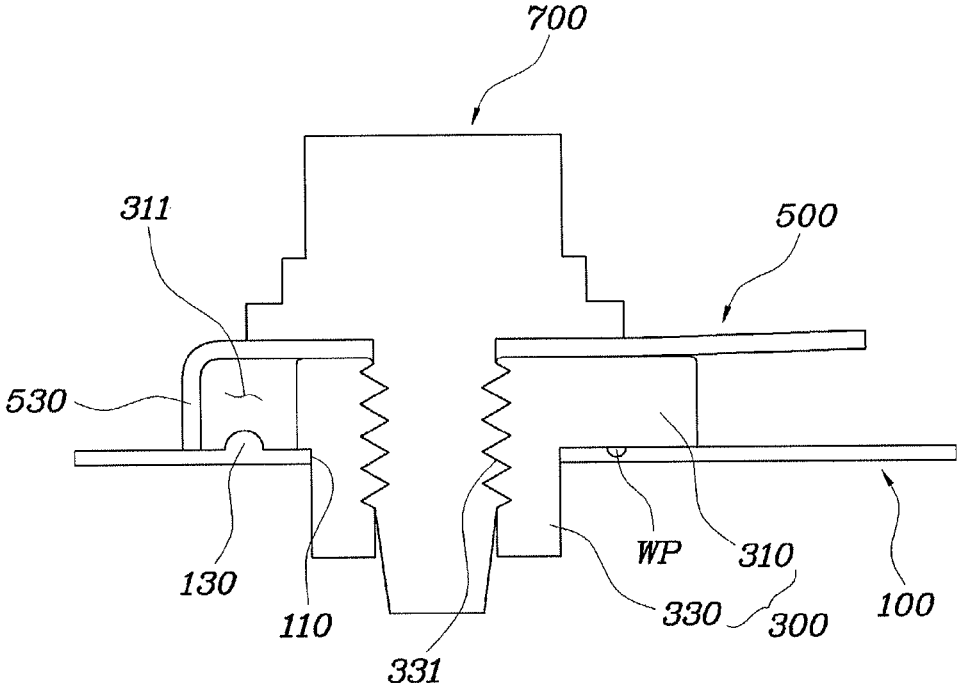
FIG. 2 is a cross-sectional view taken along line A-A of FIG. 1.
Figure 3:
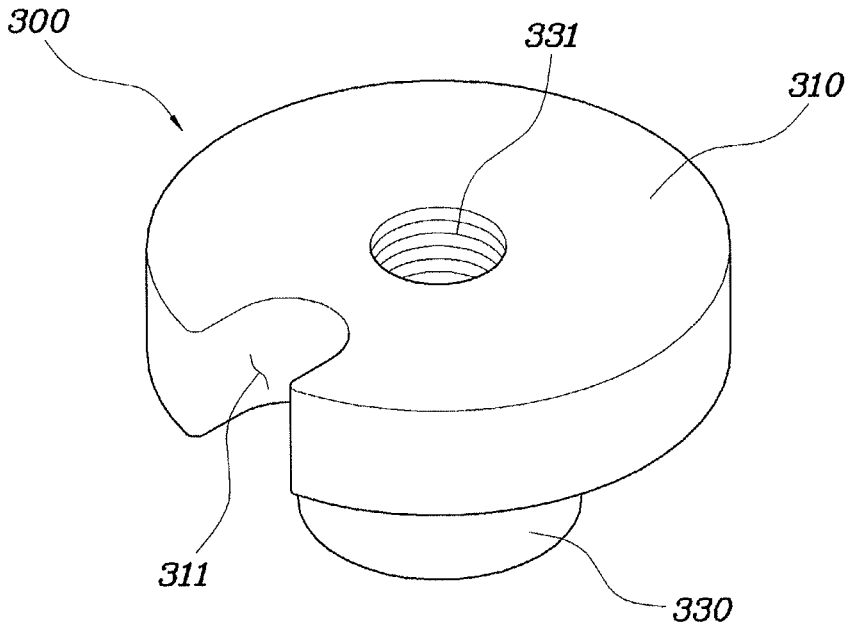
FIG. 3 is a view showing an exemplary fastener according to the present invention.
Figure 4:
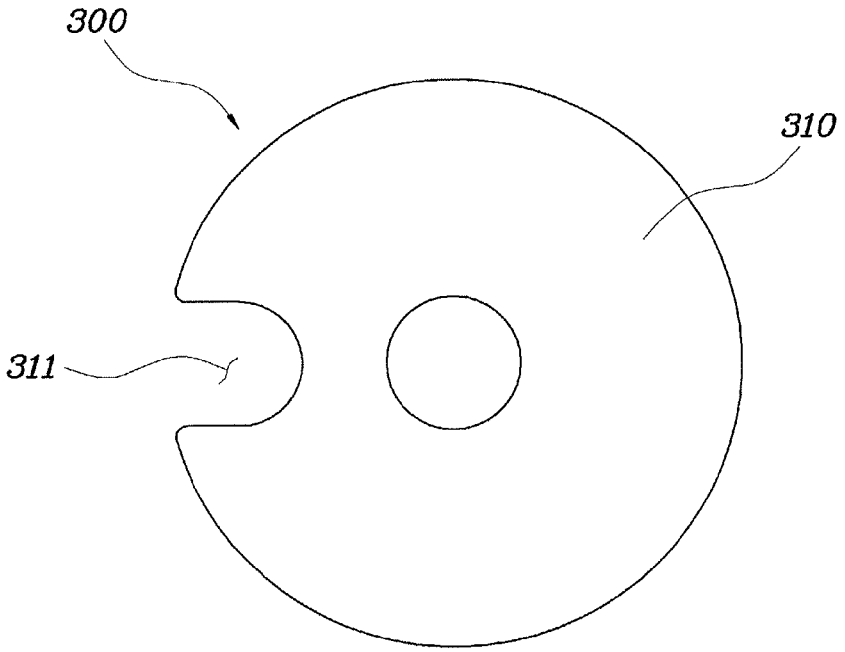
FIG. 4 is a top view of FIG. 3.
Figure 5:
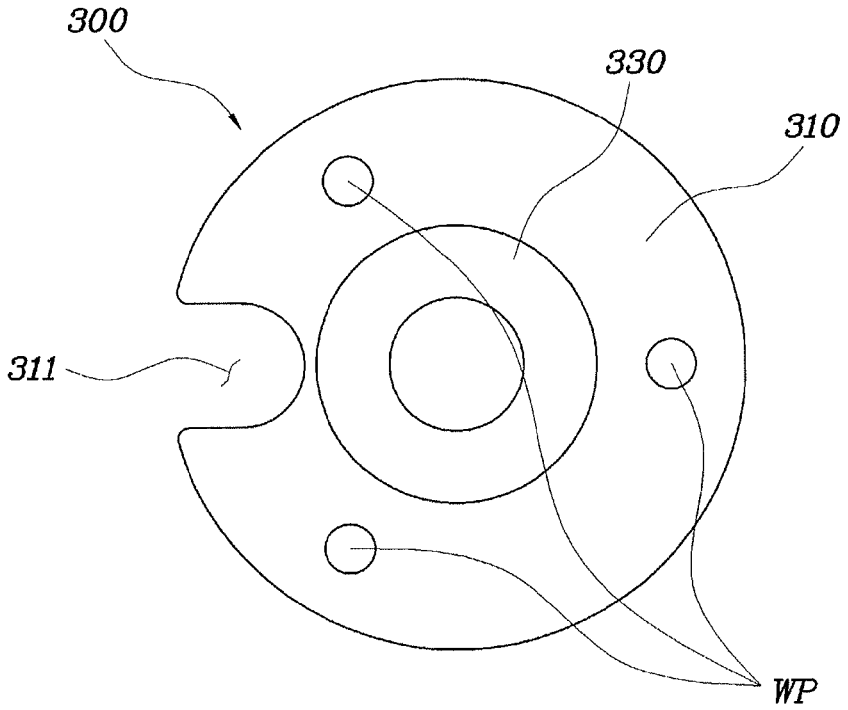
FIG. 5 is a bottom view of FIG. 3.

FIG. 1 is a view showing an earth apparatus of a vehicle according to various embodiments of the present invention and FIG. 2 is a cross-sectional view taken along line A-A of FIG. 1. FIG. 3 is a view showing a fastener according to various embodiments of the present invention, FIG. 4 is a top view of FIG. 3, and FIG. 5 is a bottom view of FIG. 3.

An earth apparatus of a vehicle according to various embodiments of the present invention includes: a panel 100 having a through-hole 110, a fastener 300 having a panel-shaped support portion 310 with an open side 311 at one side and a nut portion 330 fitted in the through-hole 110 of the panel 100; and an earth member 500 combined or coupled by the fastener 300, connected with an earth wire 510 at one side, and having a guide 530 bending downward as long as a predetermined length at the other side such that the guide 530 is combined or coupled at a position corresponding to the open side 311.

The through-hole 110 is formed at the panel 100 and a protrusion 130 protruding upward at a predetermined distance from the through-hole 110 is formed. The protrusion 130 serves to provide directionality so that the open side 311 of the support portion 310 of the fastener 300 is combined at a position corresponding to the protrusion 130 when the fastener 300 is fixed to the panel 100, thereby improving convenience in assembling and work efficiency.

Further, the earth member 500, the same as or similar to an earth member of the related art, is elongated to both sides in a disc shape, and is connected with the earth wire 510 connected from an electric part, at one side and has a guide 530 bending downward at the other side. The guide 530 is combined at the position corresponding to the protrusion 130 of the panel 100 and the open side 311 of the fastener 300, so it improves convenience in assembling and work efficiency by providing directionality, restricts the position of the earth member 500, and prevents rotation of the earth member 500.

The fastener 300 is composed of or includes the support portion 310 and the nut portion 330 and the support portion 310 of the fastener 300 is formed in the shape of a disc having a predetermined thickness. The fastener 300 is a weld nut and FIG. 5 shows that the fastener is welded to the panel 100 by a 3-point weld points (WP), but it may be freely changed in accordance with the design or the environment.

Further, a coupling member 700 mounted on the fastener 300 is provided, the coupling member 700 is generally a bolt, and a thread 331 is formed on the inner side of the nut portion 330 of the fastener 300, so the coupling member 700 is thread-fastened to the fastener 300 from above. Although the combination is achieved by welding and bolting in the above description and the drawings, the way of combination may be changed in various ways in accordance with the design or the environment and is not specifically limited.

Further, the earth member 500 is disposed between the coupling member 700 and the fastener 300, so earthing from the electric parts of a vehicle is achieved through the panel 100, and the earth member is more firmly fixed by the coupling member 700 and the fastener 300, so it is not separated even by vibration or shock in traveling of the vehicle.

According to the earth apparatus of a vehicle having the structure described above, a simple structure is achieved and a fastening force is increased, and thus the earth performance is improved. It is possible to provide directionality of the earth member, removing a guide hole of a car body panel, so assembling is easy and efficiency of the assembling process is improved.

Further, since a weld nut with a circular support portion is used, the fastening performance to the panel is improved and airtightness on the panel of a car body is ensured. Accordingly, foreign substances are prevented from flowing into the interior of a vehicle, which increases durability of the vehicle. Further, the NVH performance is improved and an exhaust gas is prevented from flowing into the interior.

For convenience in explanation and accurate definition in the appended claims, the terms "upward" or "downward", "inner" or "outer", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An earth apparatus of a vehicle, comprising:

a panel having a through-hole;

a fastener having a panel-shaped support portion with an open side at one side and a nut portion fitted in the through-hole of the panel; and an earth member combined by the fastener, connected with an earth wire at a first side of the earth member, and having a guide bending downward at a predetermined length at a second side of the earth member such that the guide is combined at a position corresponding to the open side of the panel-shaped support portion of the fastener, wherein the panel-shaped support portion is disposed between the panel and the earth member, wherein the panel-shaped support portion and the nut portion are integrally formed, and wherein the guide is directly earthed to the panel through the open side of the panel-shaped support portion.

2. The earth apparatus of claim 1, wherein a protrusion protruding upward is formed on the panel, at a predetermined distance from the through-hole.

3. The earth apparatus of claim 2, wherein the protrusion of the panel provides guidance for combining the open side of the support portion of the fastener to the panel at a position corresponding to the protrusion.

4. The earth apparatus of claim 1, wherein the support portion of the fastener is formed in a shape of a disc having a predetermined thickness.

5. The earth apparatus of claim 1, wherein the fastener is a weld nut.

6. The earth apparatus of claim 1, wherein a coupling member is fitted in the fastener from above.

7. The earth apparatus of claim 6, wherein the earth member is disposed between the coupling member and the fastener.

8. The earth apparatus of claim 6, wherein the coupling member is a bolt and a thread is formed on an inner side of the nut portion of the fastener.

* * * * *